US007076426B1

(12) United States Patent
Beutnagel et al.

(10) Patent No.: US 7,076,426 B1
(45) Date of Patent: Jul. 11, 2006

(54) ADVANCE TTS FOR FACIAL ANIMATION

(75) Inventors: Mark Charles Beutnagel, Mendham, NJ (US); Joern Ostermann, Red Bank, NJ (US); Schuyler Reynier Quackenbush, Westfield, NJ (US)

(73) Assignee: AT&T Corp., New York, NY (US)

( * ) Notice: Subject to any disclaimer, the term of this patent is extended or adjusted under 35 U.S.C. 154(b) by 0 days.

(21) Appl. No.: 09/238,224

(22) Filed: Jan. 27, 1999

Related U.S. Application Data

(60) Provisional application No. 60/082,393, filed on Apr. 20, 1998, provisional application No. 60/073,185, filed on Jan. 30, 1998.

(51) Int. Cl.
*G10L 13/08* (2006.01)

(52) U.S. Cl. ..... 704/260; 704/266

(58) Field of Classification Search ..... 704/258, 704/260, 270

See application file for complete search history.

(56) References Cited

U.S. PATENT DOCUMENTS 4,852,168 A * 7/1989 Sprague ..... 704/211
4,896,359 A * 1/1990 Yamamoto et al. ..... 704/260
4,979,216 A * 12/1990 Malsheen et al. ..... 704/260
5,384,893 A * 1/1995 Hutchins ..... 704/267
5,400,434 A * 3/1995 Pearson ..... 704/264
5,636,325 A * 6/1997 Farrett ..... 704/258
5,642,466 A * 6/1997 Narayan ..... 704/260
5,682,501 A * 10/1997 Sharman ..... 704/260
5,913,193 A * 6/1999 Huang et al. ..... 704/258
5,943,648 A * 8/1999 Tel ..... 704/270.1
5,970,459 A * 10/1999 Yang et al. ..... 704/276
6,038,533 A * 3/2000 Buchsbaum et al. ..... 704/260
6,052,664 A * 4/2000 Van Coile et al. ..... 704/260
6,088,673 A * 7/2000 Lee et al. ..... 704/260
6,101,470 A * 8/2000 Eide et al. ..... 704/260
6,240,384 B1 * 5/2001 Kagoshima et al. ..... 704/220
6,260,016 B1 * 7/2001 Holm et al. ..... 704/260
6,366,883 B1 * 4/2002 Campbell et al. ..... 704/258

OTHER PUBLICATIONS

Lee et al, "The Synthesis Riles in a Chinese Text to Speech System", IEEE Transactions on Acoustics, Speech, and Signal Processing, vol. 37 #9, Sep. 1989 pp. 1309-1320.*

* cited by examiner

*Primary Examiner*—Richemond Dorvil
*Assistant Examiner*—Michael N. Opsasnick
(74) *Attorney, Agent, or Firm*—Henry T. Brendzel

(57) ABSTRACT

An enhanced system is achieved by allowing bookmarks which can specify that the stream of bits that follow corresponds to phonemes and a plurality of prosody information, including duration information, that is specified for times within the duration of the phonemes. Illustratively, such a stream comprises a flag to enable a duration flag, a flag to enable a pitch contour flag, a flag to enable an energy contour flag, a specification of the number of phonemes that follow, and, for each phoneme, one or more sets of specific prosody information that relates to the phoneme, such as a set of pitch values and their durations.

29 Claims, 2 Drawing Sheets

ADVANCE TTS FOR FACIAL ANIMATION

REFERENCE TO A RELATED APPLICATION

This invention claims the benefit of provisional application No. 60/073,185, filed Jan. 30, 1998, titled "Advanced TTS For Facial Animation," which is incorporated by reference herein, and of provisional application No. 60/082,393, filed Apr. 20, 1998, titled "FAP Definition Syntax for TTS Input." This invention is also related to a copending application, filed on even date hereof, titled "FAP Definition Syntax for TTS Input," which claims priority based on the same provisional applications.

BACKGROUND OF THE INVENTION

The success of the MPEG-1 and MPEG-2 coding standards was driven by the fact that they allow digital audio-visual services with high quality and compression efficiency. However, the scope of these two standards is restricted to the ability of representing audiovisual information similar to analog systems where the video is limited to a sequence of rectangular frames. MPEG-4 (ISO/IEC JTC1/SC29/WG11) is the first international standard designed for true multimedia communication, and its goal is to provide a new kind of standardization that will support the evolution of information technology.

When synthesizing speech from text, MPEG 4 contemplates sending a stream containing text, prosody and bookmarks that are embedded in the text. The bookmarks provide parameters for synthesizing speech and for synthesizing facial animation. Prosody information includes pitch information, energy information, etc. The use of FAPs embedded in the text stream is described in the aforementioned copending application, which is incorporated by reference. The synthesizer employs the text to develop phonemes and prosody information that are necessary for creating sounds that corresponds to the text.

The following illustrates a stream that may be applied to a synthesizer, following the application of configuration signals. FIG. 1 provides a visual representation of this stream.

| Syntax: | # of bits |
|---|---|
| TTS_Sentence( ) { | |
| TTS__Sentence__Start__Code | 32 |
| TTS__Sentence__ID | 10 |
| Silence | 1 |
| if (Silence) | |
| Silence__Duration | 12 |
| else { | |
| if (Gender__Enable) | |
| Gender | 1 |
| if (Age__Enable) | |
| Age | 3 |
| if(!Video__Enable & Speech__Rate__enable) | |
| Speech Rate | 4 |
| Length__of__Text | 12 |
| For (j=0; j<=Length__of__Text; j++) | |
| TTS__Text | 8 |
| if (Video__Enable) { | |
| if (Dur Enable) { | |
| Sentence__Duration | 16 |
| Postion__in__Sentence | 16 |
| Offset | 10 |
| } | |
| } | |
| if (Lip__Shape__Enable) { | |

-continued

| Syntax: | # of bits |
|---|---|
| Number__of Lip__Shape | 10 |
| for (j=0; j<Number__of__Lip__Shape; j++) { | |
| If (Prosody__Enable) { | |
| If (Dur__Enable) | |
| Lip__Shape__Time__in__Sentence | 16 |
| Else | |
| Lip__Shape__Phoneme__Number__in__Sentence | 13 |
| } | |
| else | |
| Lip-Shape__Letter__Number__in__Sentence | 12 |
| Lip__Shape | 8 |
| } | |
| } | |
| } | |

Block 10 of FIG. 1 corresponds to the first 32 bits which specify a start of sentence code, and the following 10 bits that provide a sentence ID. The next bit indicates whether the sentence comprises a silence or voiced information, and if it is a silence, the next 12 bits specify the duration of the silence (block 11). Otherwise, the data that follows, as shown in block 13 provides information as to whether the Gender flag should be set in the synthesizer (1 bit), and whether the Age flag should be set in the synthesizer (1 bit). If the previously entered configuration parameters have set the Video_Enable flag to 0 and the Speech_Rate_Enable flag to 1 (block 14 of FIG. 1), then the next 4 bits indicate the speech rate. This is shown by block 14 of FIG. 1. Thereafter, the next 12 bits indicate the number of text bytes that will follow. This is shown by block 16 of FIG. 1. Based on this number, the subsequent stream of 8 bit bytes is read as the text input (per block 17 of FIG. 1) in the "for" loop that reads TTS_Text. Next, if the Video_Enable flag has been set by the previously entered configuration parameters (block 18 in FIG. 1), then the following 42 bits provide the silence duration (16 bits) the Position_in_Sentence (16 bits) and the Offset (10 bits), as shown in block 19 of FIG. 1. Lastly, if the Lip_Shape_Enable flag has been set by the previously entered configuration parameters (block 20), then the following 51 bits provide information about lip shapes (block 21). This includes the number of lip shapes provided (10 bits), and the Lip_Shape_Time_in_Sentence (16 bits) if the Prosody_Enable and the Dur_Enable flags are set. If the Prosody_Enable flag is set but the Dur_Enable flag is not set, then the next 13 bits specify the Lip_shape_Phonem_Number_in_Sentence. If the Prosody_Enable flag is not set, then the next 12 bits provide the Lip_Shaper_letter_Number_in_Sentence information. The sentence ends with a number of lip shape specifications (8 bits each) corresponding to the value provided by Number_of_Lip_Shape field.

MPEG 4 provides for specifying phonemes in addition to specifying text. However, what is contemplated is to specify one pitch specification, and 3 energy specification, and this is not enough for high quality speech synthesis, even if the synthesizer were to interpolate between pairs of pitch and energy specifications. This is particularly unsatisfactory when speech is aimed to be slow and rich is prosody, such as when singing, where a single phoneme may extend for a long time and be characterized with a varying prosody.

SUMMARY OF THE INVENTION

An enhanced system is achieved which can specify that the stream of bits that follow corresponds to phonemes and a plurality of prosody information, including duration information, that is specified for times within the duration of the phonemes. Illustratively, such a stream comprises a flag to enable a duration flag, a flag to enable a pitch contour flag, a flag to enable an energy contour flag, a specification of the number of phonemes that follow, and, for each phoneme, one or more sets of specific prosody information that relates to the phoneme, such as a set of pitch values and their durations or temporal positions.

DETAILED DESCRIPTION

In accordance with the principles disclosed herein, instead of relying on the synthesizer to develop pitch and energy contours by interpolating between a supplied pitch and energy value for each phoneme, a signal is developed for synthesis which includes any number of prosody parameter target values. This can be any number, including 0. Moreover, in accordance with the principles disclosed herein, each prosody parameter target specification (such as amplitude of pitch or energy) is associated with a duration measure or time specifying when the target has to be reached. The duration may be absolute, or it may be in the form of offset from the beginning of the phoneme or some other timing marker.

Figure 1:
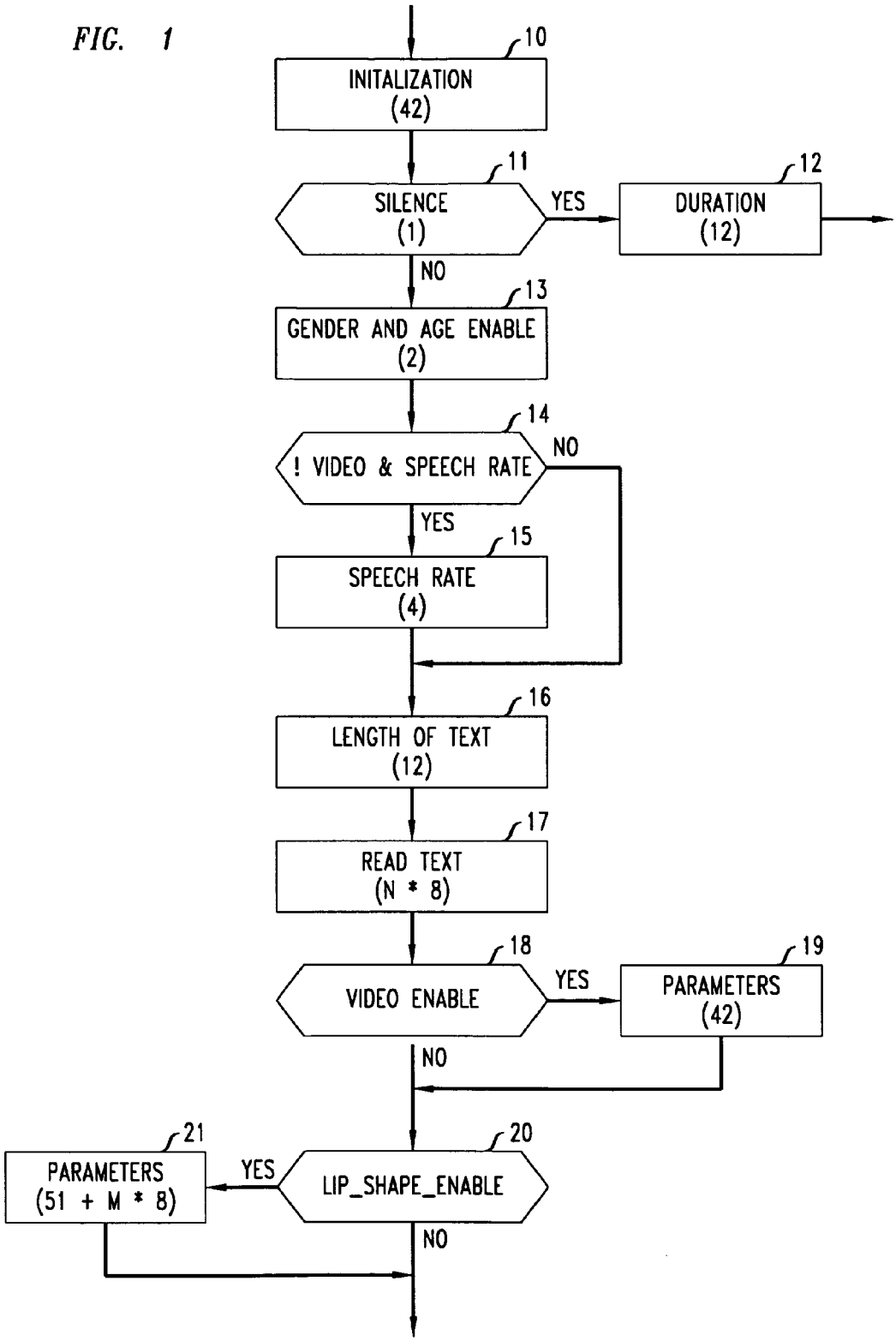
FIG. 1 visually represents signal components that may be applied to a speech synthesizer.
Figure 2:
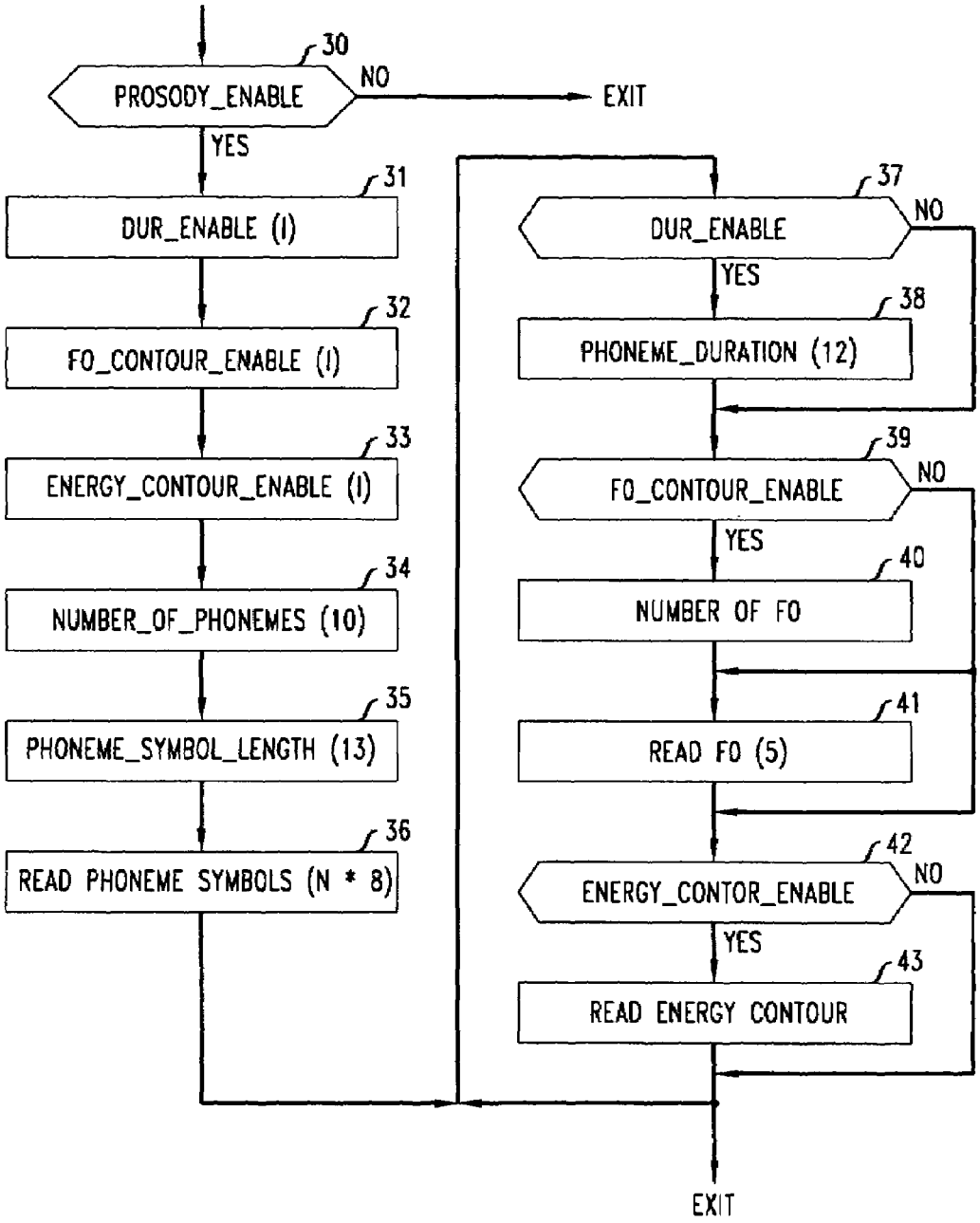
FIG. 2 visually represents signal components that may be added, in accordance with the principles disclosed herein, to augment the signal represented in FIG. 1

A stream of data that is applied to a speech synthesizer in accordance with this invention may, illustratively, be one like described above, augmented with the following stream, inserted after the TTS_Text readings in the "for (j=0; j<Length_of_Text; j++)" loop. FIG. 2 provides a visual presentation of such a stream of bits that, correspondingly, is inserted following block 16 of FIG. 1.

```
if (Prosody_Enable) {
  Dur_Enable 1
  F0_Contour_Enable 1
  Energy_Contour_Enable 1
  Number_of_Phonemes 10
  Phonemes_Symbols_length 13
  for (j=0; j<Phoneme_Symbols_Length; j++)
    Phoneme_Symbols 8
  for (j=0; j<Number_of_Phonemes; j++) {
    if (Dur_Enable)
      Dur_each Phoneme 12
    if (F0_Contour_Enable) {
      num_F0 5
      for (j=0; j<num_FO; j++) {
        F0_Contour_Each_Phoneme 8
        F0_Contour_Each_Phoneme_time 12
        }
      }
    if (Energy_Contour_Enable)
      Energy_Contour_Each_Phoneme 24
    }
  }
```

Proceeding to describe the above, if the Prosody_Enable flag has been set by the previously entered configuration parameters (block 30 in FIG. 2), the first bit in the bit stream following the reading of the text is a duration enable flag, Dur_Enable, which is 1 bit. This is shown by block 31. Following the Dur_Enable bit comes a one bit pitch enable flag, F0_Enable, and a one bit energy contour enable flag, Energy Contour_Enable (blocks 32 and 33). Thereafter, 10 bits specify the number of phonemes that will be supplied (block 34) and the following 13 bits specify the number of 8 bit bytes that are required to be read (block 35) in order to obtain the entire set of phoneme symbols. Thence, for each of the specified phoneme symbols, a number of parameters are read as follows. If the Dur_Enable flag is set (block 37), the duration of the phoneme is specified in a 12 bit field (block 38). If the F0_Contour_Enable flag is set (block 39), then the following 5 bits specify the number of pitch specifications (block 40), and based on that number, pitch specifications are read in fields of 20 bits each (block 41). Each such field comprises 8 bits that specify the pitch, and the remaining 12 bits specify duration, or time offset. Lastly, if the Energy_Contour_Enable flag is set (block 42), the information about the energy contours is read in the manner described above in connection with the pitch information (block 43).

It should be understood that the collection and sequence of the information presented above and illustrated in FIG. 2 is merely that: illustrative. Other sequences would easily come to mind of a skilled artisan, and there is no reason why other information might not be included as well. For example, the sentence "hello world" might be specified by the following sequence:

| Phoneme | Stress | Duration | Pitch and Energy Specs. |
|---|---|---|---|
| # | 0 | 180 | |
| h | 0 | 50 | P118@0 P118@24 A4096@0 |
| e | 3 | 80 | |
| l | 0 | 50 | P105@19 P118@24 |
| o | 1 | 150 | P117@91 P112@141 P137@146 |
| # | 1 | | |
| w | 0 | 70 | A4096@35 |
| o | | | |
| R | 1 | 210 | P133@43 P84@54 A3277@105 A3277@210 |
| l | 0 | 50 | P71@50 A3077@25 A2304@80 |
| d | 0 | 38 + 40 | A4096@20 A2304@78 |
| # | | | |
| * | 0 | 20 | P7@20 A0@20 |

It may be noted that in this sequence, each phoneme is followed by the specification for the phone, and that a stress symbols is included. A specification such as P133@43 in association with phoneme "R" means that a pitch value of 133 is specified to begin at 43 msec following the beginning of the "R" phoneme. The prefix "P" designates pitch, and the prefix "A" designates energy, or amplitude. The duration designation "38+40" refers to the duration of the initial silence (the closure part) of the phoneme "d," and the 40 refers to the duration of the release part that follows in the phoneme "d." This form of specification is employed in connection with a number of letters that consist of an initial silence followed by an explosive release part (e.g. the sounds corresponding to letters p, t, and k). The symbol "#" designates an end of a segment, and the symbol "*" designates a silence. It may be noted further that a silence can have prosody specifications because a silence is just another phoneme in a sequence of phonemes, and the prosody of an entire word/phrase/sentence is what is of interest. If specifying pitch and/or energy within a silence interval would improve the overall pitch and/or energy contour, there is no reason why such a specification should not be allowed.

It may be noted still further that allowing the pitch and energy specifications to be expressed in terms of offset from the beginning of the interval of the associated phoneme allows one to omit specifying any target parameter value at the beginning of the phoneme. In this manner, a synthesizer receiving the prosody parameter specifications will generate, at the beginning of a phoneme, whatever suits best in the effort to meet the specified targets for the previous and current phonemes.

An additional benefit of specifying the pitch contour as tuples of amplitude and time offset of duration is that a smaller amount of data has to be transmitted when compared to a scheme that specifies amplitudes at predefined time intervals.

We claim:

1. A method for generating a signal rich in prosody information comprising the steps of:

inserting in said signal a plurality of phonemes represented by phoneme symbols, inserting in said signal a duration specification associated with each of said phonemes, inserting, for at least one of said phonemes, a plurality of at least two prosody parameter specifications, with each specification of a prosody parameter specifying a target value for said prosody parameter, and a point in time for reaching said target value, which point in time is follows beginning of the phoneme and precedes end of the phoneme, unrestricted to any particular point within said duration, and allowing value of said prosody parameter to permissibly be at other than said target value except at said specified point in time, to thereby generate a signal adapted for converting into speech.

2. The method of claim 1 where said at least one phoneme has two prosody parameter specifications that specify pitch.

3. The method of claim 1 where at least one of said two prosody parameter specifications specifies energy.

4. The method of claim 1 where source of information for said phonemes is text.

5. The method of claim 1 where either one of said at least two prosody specifications specifies an energy with a target value corresponding to silence.

6. The method of claim 1 where said point in time for reaching target value of a specified prosody parameter of a phoneme from said plurality of phonemes is expressed in terms of time offsets from the beginning of phonemes.

7. The method of claim 1 where said point in time is specified as an offset from beginning of said one of said phonemes.

8. The method of claim 1 where said at least two prosody parameter specifications comprise at least two pitch specifications.

9. The method of claim 1 where said at least two prosody parameter specifications comprise at least two pitch specifications followed by an energy specification.

10. The method of claim 1 where said at least two prosody parameter specifications comprise a plurality of one or more pitch specifications and a plurality of one or more energy specifications.

11. The method of claim 1 where said signal also includes text specifications.

12. The method of claim 11 where said signal also includes image specifications.

13. The method of claim 1 where said at least one of said phonemes includes more than two prosody parameter specifications, with each specification of a prosody parameter specifying a target value for said prosody parameter to reach and a point in time for reaching said target value, which point in time is not a priori restricted to any particular point within said duration.

14. The method of claim 13 where each of at least two of said more than two parameter specifications specifies a pitch target value and a time for reaching said pitch target value.

15. The method of claim 13 where each of at least two of said more than two parameter specifications specifies an energy target value and a time for reaching said energy target value.

16. A method for generating a signal rich in prosody information comprising:

a first step for inserting in said signal a plurality of phoneme symbols, a second step for inserting in said signal a desired duration of each of said phoneme symbols, a third step for inserting, for at least one of said phonemes, at least one prosody parameter specification that consists of a target value that said prosody parameter is to reach within said duration of said at least one of said phonemes, a time offset from the beginning of the duration of said phoneme that is greater than zero and less than the duration of said phoneme for reaching said target value, and a delimiter between said target value and said time offset.

17. A method of claim 16 where said prosody parameter value is unrestricted at other than said chosen time offset.

18. The method for creating a signal responsive to a text input that results in a sequence of descriptive elements, including, a TTS sentence ID element; a gender specification element, if gender specification is desired; an age specification element, if gender specification is desired; a number of text units specification element; and a detail specification the text units, the improvement comprising the step of:

including in said detail specification of said text units preface information that includes indication of number of phonemes, for each phoneme of said phonemes, an indication of number of parameter information collections, N, and for each phoneme of said phonemes, N parameter information collections, each of said collections specifying a prosody parameter target value and a selectably chosen point in time for reaching said target value.

19. The method of claim 18 where said text units are bytes of text.

20. The method of claim 18 where said parameter information collections relate to pitch.

21. The method of claim 18 where N is an integer greater than 1.

22. The method of claim 18 where said preface includes a Dur_Enable indicator, and when said Dur_Enable indicator is at a predetermined state, said step of including also includes, a phoneme duration value for each phoneme of said phonemes.

23. The method of claim 18 where said preface includes an F0_Contour_Enable indicator that is set at a predetermined state when said signal includes said N parameter information collections.

24. The method of claim 18 where said preface includes a listing of said phonemes.

25. The method of claim 18 where said preface includes a Energy_Contour_Enable indicator, and when said Energy_Contour_Enable indicator is at a predetermined state, said step of including also includes, one or more energy value parameters.

26. The method of claim 25 where said energy value parameters specify energy at beginning, middle, or/and end of phoneme pertaining to said Energy_Contour_Enable indicator.

27. A method for generating a signal for a chosen synthesizer that employs text, phoneme, and prosody information input to generate speech, comprising the steps of:

receiving a first number, M, of phonemes specification;

receiving, for at least some phoneme, a second number, N, representing number of parameter information collections to be received for the phoneme;

receiving N parameter information collections, each of said collections specifying a parameter target value and a time for reaching said target value;

translating said parameter information collections to form translated prosody information that is suitable for said chosen synthesizer; and including said translated prosody information in said signal.

28. The method of claim 27 further comprising:

a step, preceding said step of receiving said second number, M phoneme specifications; and a step of including in said signal phoneme specification information pertaining to said received M phoneme specifications, which information is compatible with said chosen synthesizer.

29. The method of claim 27 further comprising the steps of receiving, following said step of receiving said N parameter information collections, energy information; and including in said signal a translation of said energy information, which translation is adapted for employment of the translated energy information by said chosen synthesizer.

* * * * *